US006431779B1

(12) United States Patent
Moor et al.

(10) Patent No.: US 6,431,779 B1
(45) Date of Patent: Aug. 13, 2002

(54) BINDER WITH EXPANDABLE POCKET

(75) Inventors: Marc L. Moor, Oakwood, OH (US); Thomas DeBlasis, Pittsburgh, PA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/528,052

(22) Filed: Mar. 17, 2000

Related U.S. Application Data

(60) Provisional application No. 60/124,943, filed on Mar. 18, 1999.

(51) Int. Cl.[7] ..... B42F 13/00

(52) U.S. Cl. ..... 402/73; 402/70; 281/29; 281/31; 281/37

(58) Field of Search ..... 402/4, 70, 73, 402/80 R; 281/21.1, 15.1, 36, 37, 51, 31; 206/425, 472, 475

(56) References Cited

U.S. PATENT DOCUMENTS

| | | | | |
|---|---|---|---|---|
| 138,217 A | | 4/1873 | Wendt | |
| 1,023,834 A | | 4/1912 | Gareis | |
| 1,359,320 A | | 11/1920 | Brenan | |
| 1,492,677 A | | 5/1924 | Dunbar et al. | |
| 1,723,030 A | | 8/1929 | Gerard | |
| 1,743,305 A | | 1/1930 | Banks | |
| 2,173,120 A | | 9/1939 | Lifton | 150/1.6 |
| 2,252,783 A | | 8/1941 | Potts et al. | 129/1 |
| 2,318,192 A | | 5/1943 | Boelema, Jr. | 281/31 |
| 2,473,056 A | | 6/1949 | Henderson | 150/38 |
| 2,475,067 A | | 7/1949 | Wege | 150/35 |
| 2,737,220 A | | 3/1956 | Hoff | 150/35 |
| 3,310,321 A | | 3/1967 | Freund | 281/31 |
| 3,758,136 A | | 9/1973 | Guyer | 281/16 |
| 4,515,493 A | * | 5/1985 | Radovich | 402/4 |
| 4,782,874 A | | 11/1988 | Chartier | 150/112 |
| 4,853,994 A | | 8/1989 | Ekstein | 5/437 |
| 4,964,508 A | | 10/1990 | Balsley | 206/37.1 |
| 5,170,889 A | | 12/1992 | Cue | 206/232 |
| 5,378,022 A | | 1/1995 | French et al. | 281/31 |
| 5,411,293 A | | 5/1995 | Monzyk | 281/31 |
| 5,676,482 A | | 10/1997 | Hawkins | 402/79 |
| 5,720,564 A | | 2/1998 | Winzen | 402/3 |
| 5,738,460 A | * | 4/1998 | Flynn | 402/73 |
| 5,749,666 A | | 5/1998 | Yu | 402/18 |

FOREIGN PATENT DOCUMENTS

| | | |
|---|---|---|
| DE | 8902001 | 5/1989 |
| DE | 19532673 | 11/1996 |
| GB | 434360 | 8/1935 |

OTHER PUBLICATIONS

PCT International Search Report; PCT Application No. PCT/US00/07210; filed on 03/17/2000.

* cited by examiner

*Primary Examiner*—William Fridie, Jr.
(74) *Attorney, Agent, or Firm*—Thompson Hine LLP

(57) ABSTRACT

A binder for receiving loose leaf papers including an upper panel and a binding mechanism coupled to the upper panel. The binder further includes a lower panel coupled to the upper panel such that a pocket is formed between the lower panel and the upper panel. In another embodiment, the invention is a binder for receiving loose leaf papers including an outer cover, a panel, and a binding mechanism coupled to the panel. The panel is coupled to the outer cover such that a pocket is formed between the panel and cover, wherein the cover foldable about the binding mechanism to lie on top of the pocket.

36 Claims, 6 Drawing Sheets

BINDER WITH EXPANDABLE POCKET

This application claims priority to U.S. Provisional Application Ser. No. 60/124,943 filed Mar. 18, 1999, the contents of which are hereby incorporated by reference.

BACKGROUND OF THE INVENTION

Binders are widely used to store loose leaf papers. For example, a binder may include a three-ring binding mechanism to receive papers that have a set of holes along its inner longitudinal edge. However, there is a need for a binder that includes a pocket to receive additional papers or to receive papers without holes, wherein the pocket is easily accessible and is expandable to accommodate large amounts of papers.

SUMMARY OF THE INVENTION

The present invention is a binder having a binding mechanism and a pocket for receiving papers. The pocket is located below the binding mechanism, and is easily accessible and expandable. In one embodiment, the invention is a binder for receiving loose leaf papers including an upper panel and a binding mechanism coupled to the upper panel. The binder further includes a lower, panel coupled to the upper panel such that a pocket is formed between the lower panel and the upper panel. In another embodiment, the invention is a binder for receiving loose leaf papers including an upper panel and a binding mechanism coupled to the upper panel. The binder further includes a lower panel coupled to the upper panel such that a pocket is formed between the lower panel and the upper panel.

Other objects and advantages of the present invention will be apparent from the following description and the accompanying drawings.

DETAILED DESCRIPTION

Figure 1:
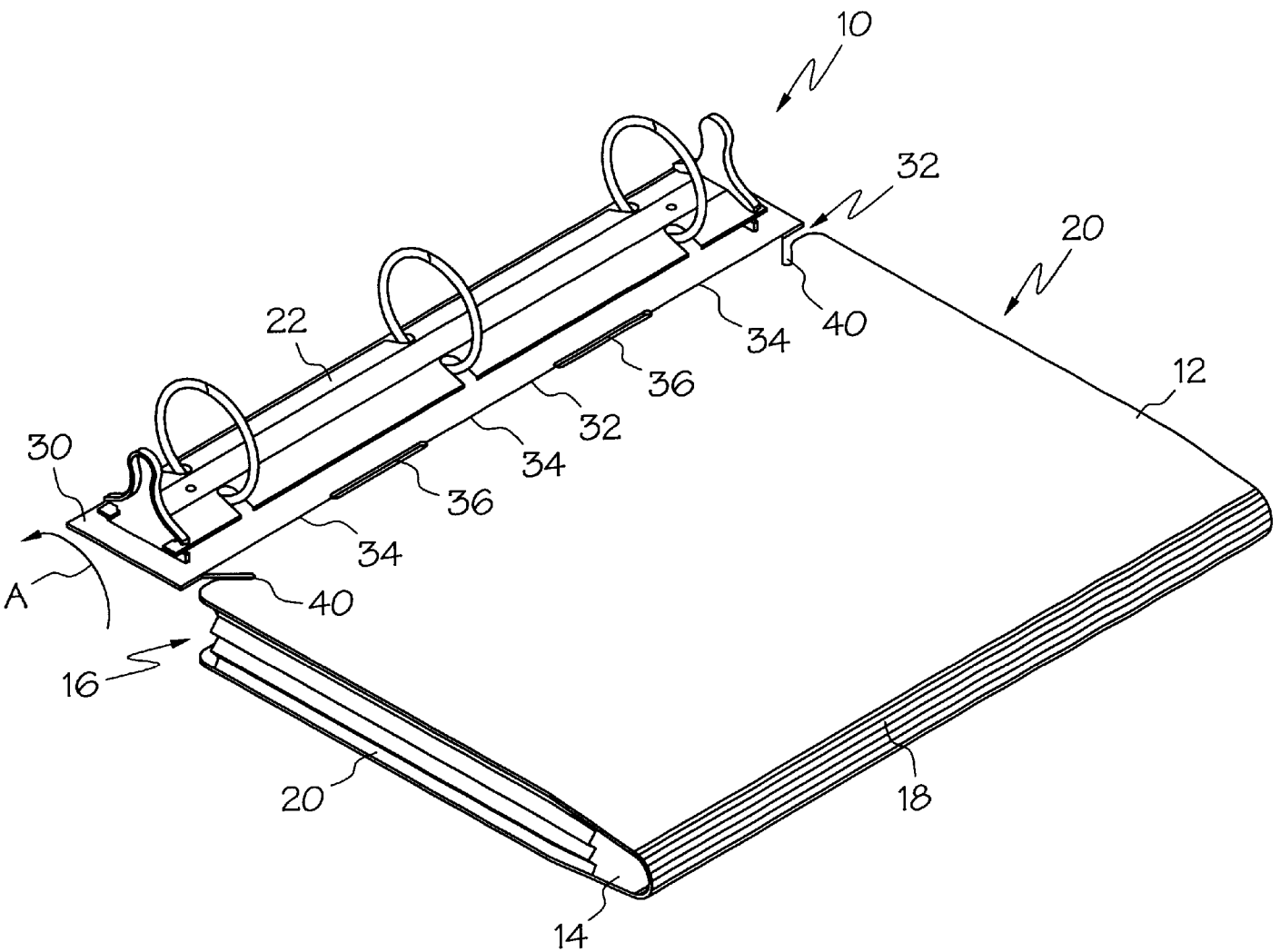
FIG. 1 is a top perspective view of one embodiment of the binder of the present invention.

As shown in FIG. 1, the binder 10 of the present invention includes an upper panel 12 and a lower panel 14 coupled to the upper panel such that a pocket 16 is formed between the upper and lower panels. The upper 12 and lower 14 panels are preferably joined by a generally flexible portion 18. The upper 12 and lower 14 panels and the flexible portion 18 are preferably made of a single piece of material that is folded upon itself to form the pocket 16. The upper 12 and lower panels 14 are preferably made from a generally rigid material, such as cardboard, plastic or polypropylene.

The pocket 16 includes a pair of opposed gussets or side panels 20. The side panels 20 can be made from a variety of materials, such as fabric, cardboard, stretchable materials, plastic, and the like. In the illustrated embodiment, the side panels 20 are made of a plastic material folded in an "accordion" style. The binder 10 also includes a binding mechanism 22, such as a three ring binding mechanism, on its outer surface. The binding mechanism 22 can be used to receive pre-punched papers, and the pocket 16 can be used to receive punched or unpunched papers, as well as other loose items. The upper panel 12 is pivotable away from the lower panel 14 via the flexible portion 18 such that the pocket 16 can be expanded to accommodate large volumes of paper.

Figure 2:
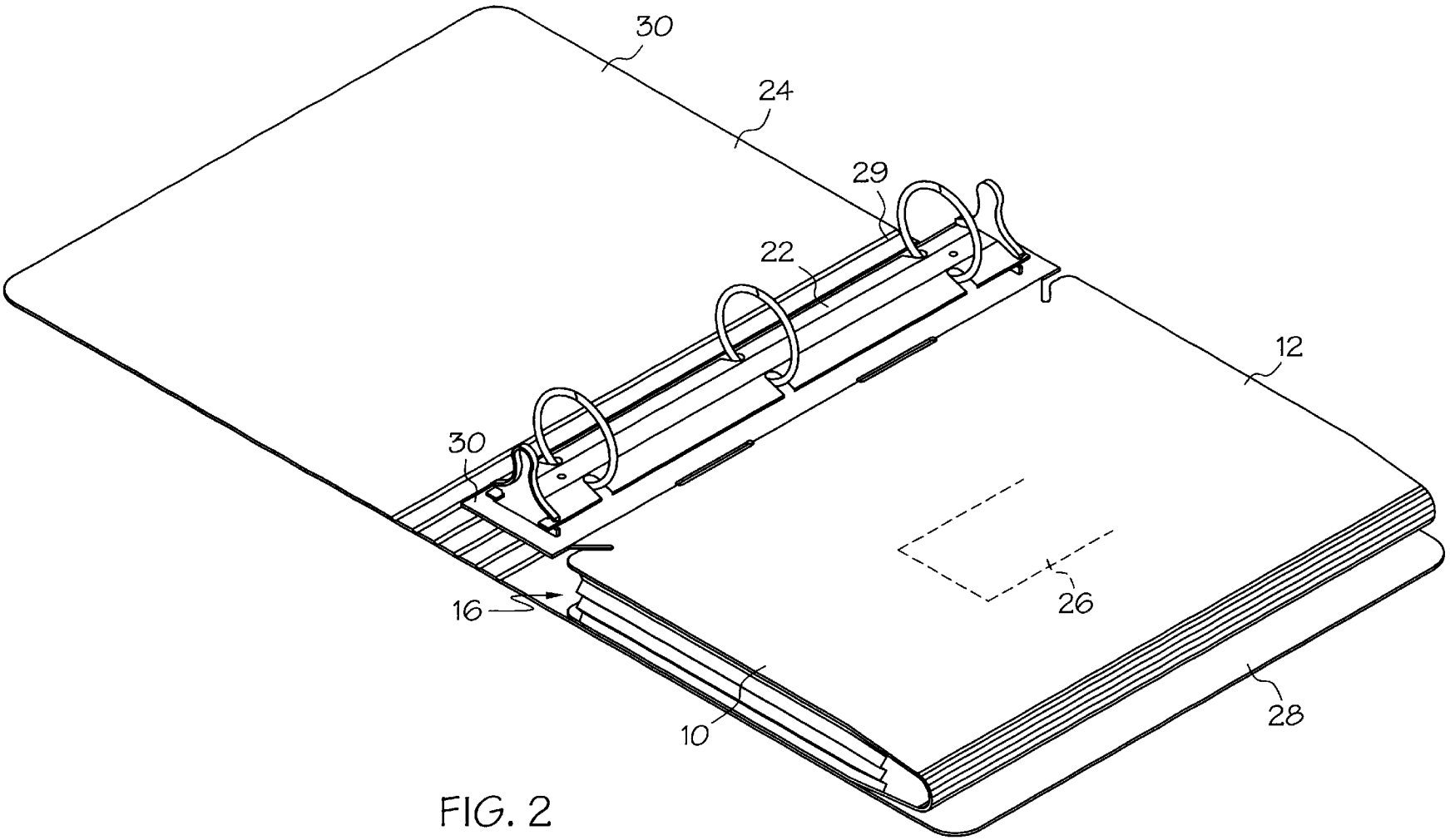
FIG. 2 is a perspective view of the binder of FIG. 1 mounted to a cover.
Figure 3:
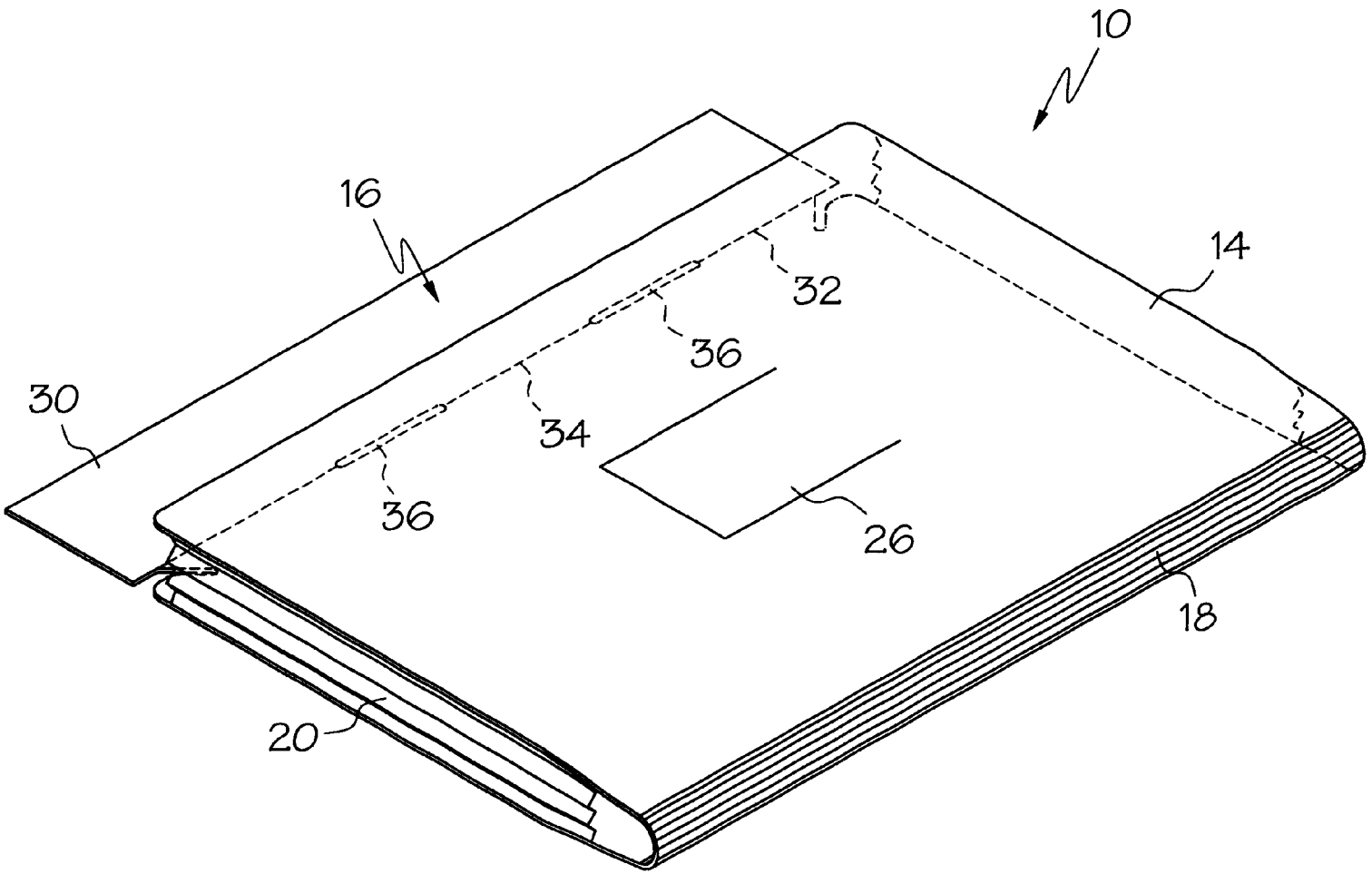
FIG. 3 is a bottom perspective view of the binder of FIG. 1.

The binder 10 may be used alone, or mounted to an outer cover 24 as shown in FIG. 2. As shown in FIG. 3, the binder 10 may include an attachment tab 26 on its lower panel 14. The attachment tab 26 may be received in a corresponding slot in the outer cover 24 to couple the binder 10 to the outer cover. Of course, a variety of mechanisms for attaching the binder 10 to the outer cover 24 may be used, including any combination of slots and tabs, hook and loop fasteners, adhesives, cut-outs and slots to receive portions of the binder, clamps, interlocking geometries such as detents received in recesses, elastic cords, stitching, and the like. The cover 24 shown in FIG. 2 includes a spine 29, a back surface 28 and a front surface 30. The front surface 30 is shown in its open position, wherein it is spaced apart from the binding mechanism 22 and the pocket 16. The front surface 30 is movable to a closed position (not shown) by pivoting the front surface about the spine 29 such that the front surface is located over the binder 10, binding mechanism 22, pocket 16 and back surface 28 to protect the components of the binder 10 and to help retain items in the pocket 16.

Returning to FIG. 1, the upper panel 12 preferably includes an extension portion 30, and the binding mechanism 22 is located on the extension portion 30. The extension portion 30 is defined by a fold line, generally designated 32, extending along the binding mechanism 22. The fold line 32 includes scored portions 34 and cut-out portions 36. The fold line 32 enables the binding mechanism 22 and extension portion 30 to rotate about their longitudinal axes in the direction of arrow A when the pocket 16 is filled with large amounts of papers.

The upper panel 12 also preferably includes a pair of notches 40 located adjacent the fold line 32. One notch 40 is located adjacent an upper edge of the upper panel 12, and the other notch is located adjacent the lower edge of the panel. Both notches 40 are located adjacent the binding mechanism 22, and provide flexibility to the upper panel 12 to enable the binding mechanism 22 and extension portion 30 to rotate in the direction of arrow A. The notches 40 preferably extend at about a 34 degree angle relative the respective bottom and top edge of the upper panel 12. The fold line 32 and notches 40 allow the upper panel 12 to flex to accommodate large volumes of materials inside the pocket 16.

Figure 4:
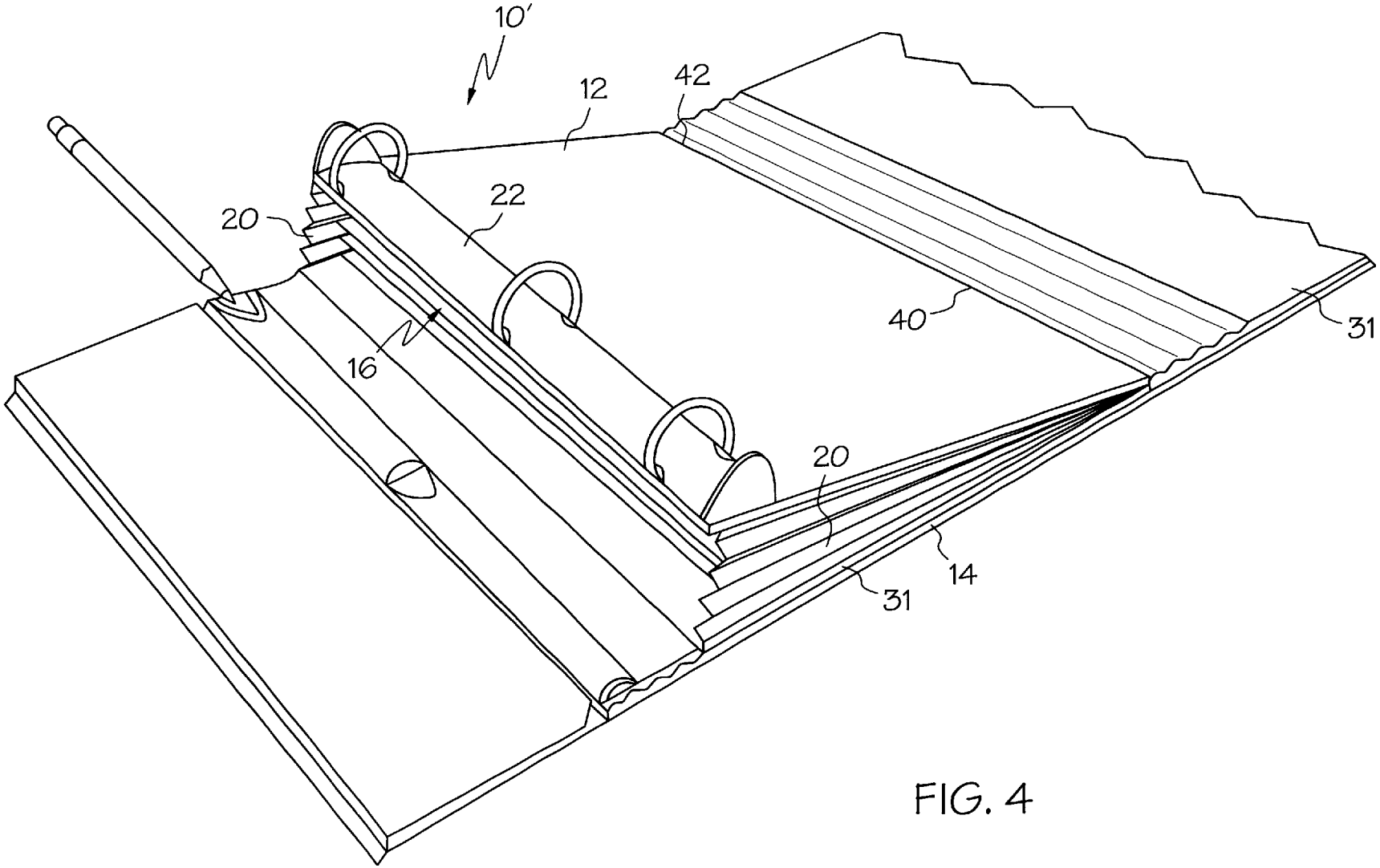
FIG. 4 is a perspective view of another embodiment of the binder of the present invention.

In an alternate embodiment shown in FIG. 4, the lower panel 14 of the binder 10' is formed by part of an outer cover 31. In this case, a longitudinal edge 40 of the upper panel 12 is coupled to the cover 31, and the side panels 20 extend between the outer cover 31 and the upper panel 12. The upper panel 12 may be attached to the outer cover adjacent a fold line 42 of the outer cover 31 that extends generally parallel to the binding mechanism 22.

Figure 5:
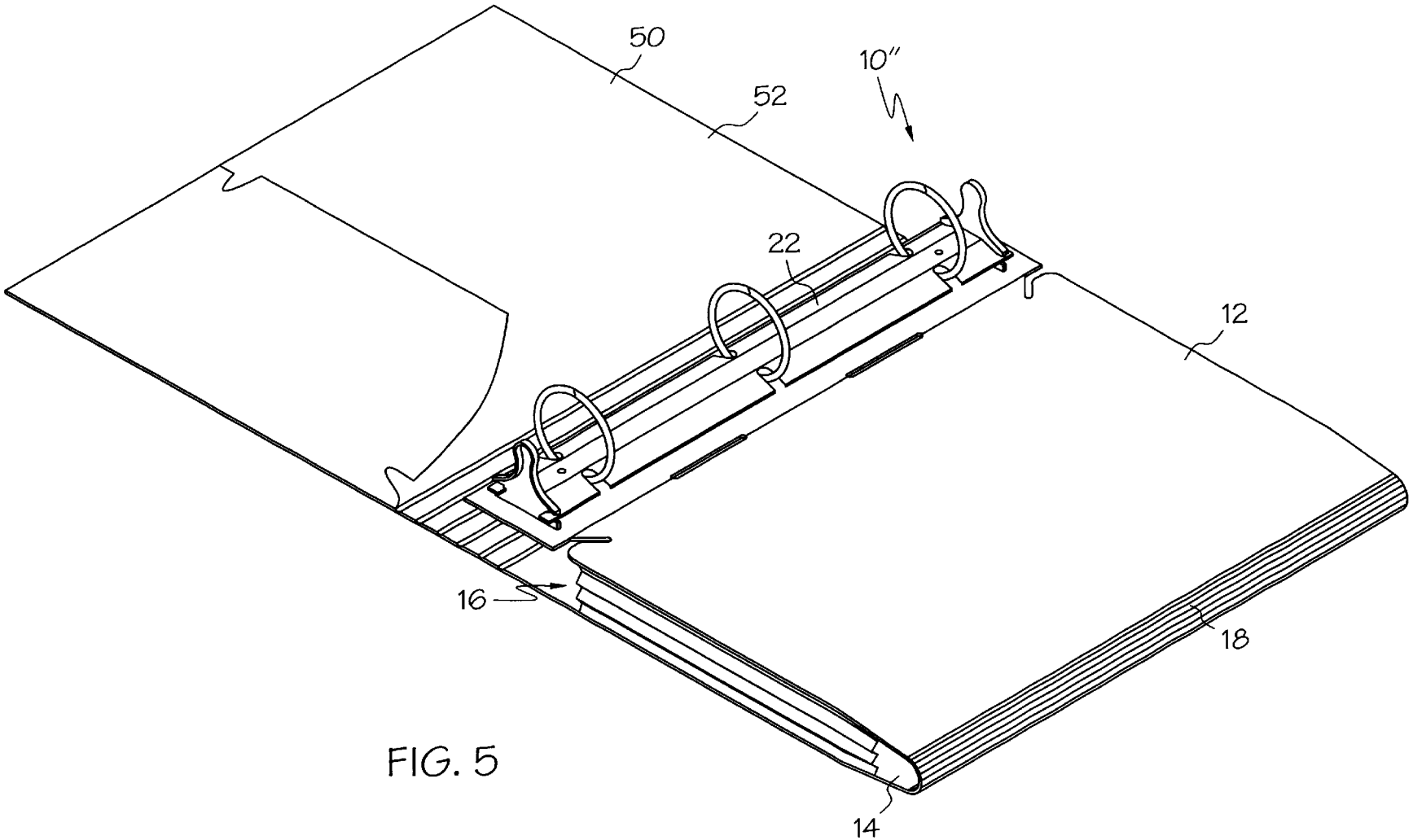
FIG. 5 is a perspective view of another embodiment of the binder of the present invention.

Another alternate embodiment of the invention is shown as binder 10" in FIG. 5. The lower panel 14 of the binder 10" is coupled to a front surface 50 of a cover 52, and the lower panel 14 also acts as the back surface of the cover 52. In this case (as in the case of the binder shown in FIG. 1) the binder 10" is preferably formed by folding a single piece of material about itself to form the pocket 16. The front surface 50 is preferably integral with the lower panel 14. Alternately, the front surface 50 of the cover 52 is a separate piece of material that is coupled to the lower panel 14 to provide protection to the binding mechanism 22 and pocket 16. The front surface 52 of the cover 50 is foldable over the upper panel 12 and the binding mechanism 22 such that the upper panel 12 and binding mechanism 22 are located between the front surface 50 of the cover 52 and the lower panel 14 of the binder.

Figure 6:
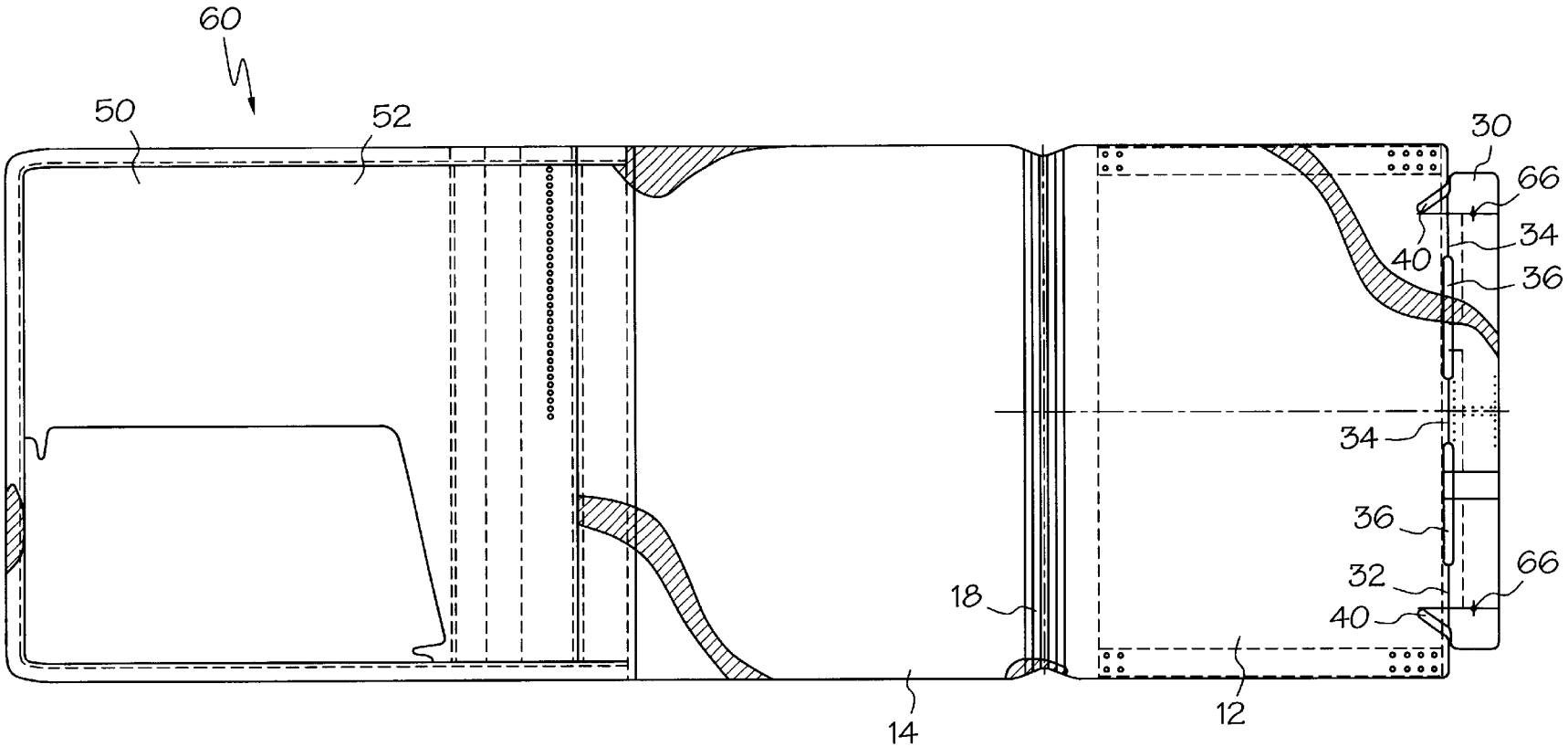
FIG. 6 is a top view of a blank used to form the binder of FIG. 5.

In a preferred embodiment, the front surface 50, lower panel 14, flexible portion 18, and upper panel 12 are made from a single piece of material. FIG. 6 illustrates a blank 60 that may be used to form the binder 10" of FIG. 5. In order to form the binder 10", the upper panel 12 is folded about the flexible portion 18 to its position shown in FIG. 5. A binding mechanism (not shown in FIG. 6) is then coupled to the extension portion 30, typically by passing rivets or the like through the holes 66 on the extension portion 30. The side panels 20 are then attached to the upper 12 and lower 14 panels.

The upper 12 and lower 14 panels are preferably made of transparent materials. This enables a user to view the documents inside the pocket 16. It is particularly useful in the embodiment of FIG. 5 to provide a transparent lower panel 14. Because the lower panel 14 of the binder is also the back surface of the cover 52, a sheet having identifying indicia may be placed in the pocket 16 such that the identifying indicia on the sheet is visible through the lower panel 14 (i.e. the back surface of the cover 50). In this manner, the identifying indicia acts as a label for the binder/cover assembly so that the user can quickly identify the contents of the binder/cover assembly. The pocket 16 preferably includes a plurality of dividers (not shown) to help organize the contents of the pocket 14.

Having described the invention in detail and by reference to the preferred embodiments, it will be apparent that modifications and variations thereof are possible without departing from the scope of the invention.

What is claimed is:

1. A binder for receiving loose leaf papers comprising:

a generally planar, rectangular upper panel;

a binding mechanism coupled to said upper panel;

a generally planar, rectangular lower panel generally parallel to said upper panel; and a pair of side panels, each side panel extending between said upper panel and said lower panel and being at least partially coupled to said upper and lower panels along an edge of each of said upper and lower panels such that a pocket is formed between said lower panel and said upper panel.

2. The binder of claim 1 wherein said upper panel and said lower panel are made of a single piece of material folded upon itself.

3. The binder of claim 1 wherein said lower panel includes an attachment means for coupling said binder to a folder.

4. The binder of claim 3 wherein said attachment means includes a tab located on one of said binder or said folder, and a slot located on the other of said binder or said folder for receiving said tab.

5. The binder of claim 1 further comprising a generally flexible portion coupling a longitudinal edge of said lower panel to a longitudinal edge of said upper panel.

6. The binder of claim 1 wherein a longitudinal edge of said upper panel is directly coupled to said lower panel.

7. The binder of claim 6 wherein said longitudinal edge of said upper panel is coupled to a fold line of said lower panel.

8. The binder of claim 1 wherein said upper panel is pivotably coupled to said lower panel.

9. The binder of claim 1 wherein said lower panel includes a lower portion located below said upper panel, and an upper portion that is foldable on top of said upper panel.

10. The binder of claim 1 wherein said side panels extend between the lateral edges of said upper and lower panels.

11. The binder of claim 1 wherein each side panel is made from an expandable material.

12. The binder of claim 1 wherein each side panel is made from "accordion" gusset material.

13. The binder of claim 1 wherein said upper panel is made of polypropylene.

14. The binder of claim 1 wherein said upper panel and said lower panel are both made of transparent material.

15. The binder of claim 1 wherein said binding mechanism is a three ring binder.

16. The binder of claim 1 wherein said upper panel includes a fold line extending adjacent to and generally parallel to said binding mechanism.

17. The binder of claim 16 wherein said fold line includes scored portions and cut-out portions.

18. The binder of claim 1 wherein said upper panel includes a pair of notches located adjacent the ends of said binding mechanism.

19. The binder of claim 18 wherein said notches are located adjacent a top edge and a bottom edge of said upper panel.

20. The binder of claim 18 wherein said notches extend at about a 35 degree angle.

21. The binder of claim 1 further comprising a plurality of pocket dividers located in said pocket.

22. A binder for receiving loose leaf papers comprising:

a generally planar outer cover;

a generally planar panel generally parallel to said outer cover, said panel including a pair of side edges; and a binding mechanism coupled to said panel, said panel being coupled to said outer cover at least partially along both of said side edges such that a pocket is formed between said panel and said cover, wherein said cover is foldable about said binding mechanism to lie on top of said pocket.

23. A binder comprising:

an outer cover having a back surface, a front surface, and a spine connecting said front surface and said back surface;

a pocket located on at least one of said front or back surfaces, said pocket having an inner cavity and an opening to provide access to said inner cavity; and a binding mechanism coupled to an upper surface of said pocket, said binding mechanism being shaped to receive papers having a set of holes punched therein, wherein at least one of said front or back surfaces is movable between a closed position wherein said at least one surface is located adjacent said binding mechanism and an open position wherein said at least one surface is not located adjacent to said binding mechanism, and wherein said opening of said pocket is located generally between said binding mechanism and said spine.

24. The binder of claim 23 wherein said outer surface, said front surface and said spine are made of single piece of material.

25. The binder of claim 24 wherein said pocket is formed by a panel located opposite one of said back surface or said front surface.

26. The binder of claim 25 wherein said panel is formed said single piece of material.

27. A binder for receiving loose leaf papers and the like comprising:

an upper panel including a pair of side edges and first and second end edges;

a lower panel including a pair of side edges and a pair of end edges;

a pair of side panels, each side panel being coupled to and extending between a side edge of said upper panel and a side edge of said lower panel;

an end panel being coupled to and extending between said first end edge of said upper panel and an end edge of said lower panel, said upper, lower, side and end panels forming a pocket therebetween; and a binding mechanism coupled to said upper panel and located adjacent said second end edge.

28. The binder of claim 27 further comprising attachment means for releasably coupling said binder to a folder.

29. The binder of claim 27 further comprising an outer cover pivotally coupled to said lower panel, said outer cover being pivotable between a closed position when said outer cover is located over said pocket and an open position wherein said outer cover is not located over said pocket.

30. The binder of claim 27 wherein said binding mechanism is located on an outer surface of said pocket.

31. The binder of claim 27 wherein said end panel pivotally couples said upper and lower panels.

32. The binder of claim 27 wherein said upper panel includes an extension portion that extends outwardly beyond said lower panel, and wherein said binding mechanism is located on said extension portion.

33. The binder of claim 32 wherein said extension portion is pivotable relative to a body of said upper panel.

34. The binder of claim 1 wherein each of said upper and lower panels each include a rear edge located adjacent to said binding mechanism, a front edge located opposite said rear edge, and a pair of side edges extending between said front and rear edges, and wherein each side panel is at least partially coupled to one of said side edges of each of said upper and lower panels.

35. The binder of claim 1 wherein said pocket includes an inner cavity and an opening to provide access to said inner cavity, and wherein said opening is located generally between said binding mechanism and said spine.

36. The binder of claim 22 further including a pair of side panels, each side panel extending between said panel and said outer cover and being at least partially coupled to said upper and lower panels along an edge of each of said upper and lower panels to form said pocket.

* * * * *